United States Patent [19]

Muus

[11] 4,376,381

[45] Mar. 15, 1983

[54] LOCK

[75] Inventor: Frank Muus, Moss, Norway

[73] Assignee: Elkem A/S, Oslo, Norway

[21] Appl. No.: 206,357

[22] Filed: Nov. 13, 1980

[30] Foreign Application Priority Data

Nov. 29, 1979 [NO] Norway ..... 793880

[51] Int. Cl.[3] ..... E05B 11/00; E05B 27/06; E05B 35/08

[52] U.S. Cl. ..... 70/337; 70/358; 70/364 A; 70/389

[58] Field of Search ..... 70/358, 364 A, 337, 70/389, 390

[56] References Cited

U.S. PATENT DOCUMENTS 3,194,034 7/1965 Leiser ..... 70/358

*Primary Examiner*—Robert L. Wolfe

*Attorney, Agent, or Firm*—Eyre, Mann, Lucas & Just

[57] ABSTRACT

The present invention relates to a pin tumbler cylinder lock comprising an outer cylinder, an inner cylinder rotatably arranged in a cylindrical opening in the outer cylinder, a key-way intended for a key and at least two rows of parallel bores arranged in the outer cylinder, in which bores spring loaded tumbler pins are slidably arranged. The at least two rows of bores have different number of bores, whereby the key will be prevented from retraction in one or more angular position of the inner cylinder. The present invention relates further to a key for such type of locks, the key having notches along its edge, the depth of which being interrelated with the length of the bottom tumbler pins. At least the notch at the extreme end of the key is removed, whereby the key may be retracted in both positions.

3 Claims, 5 Drawing Figures

Figure 1:
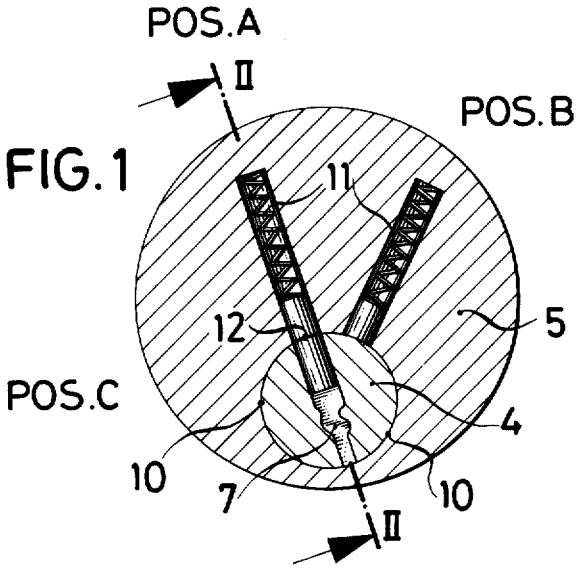
Figure 2:
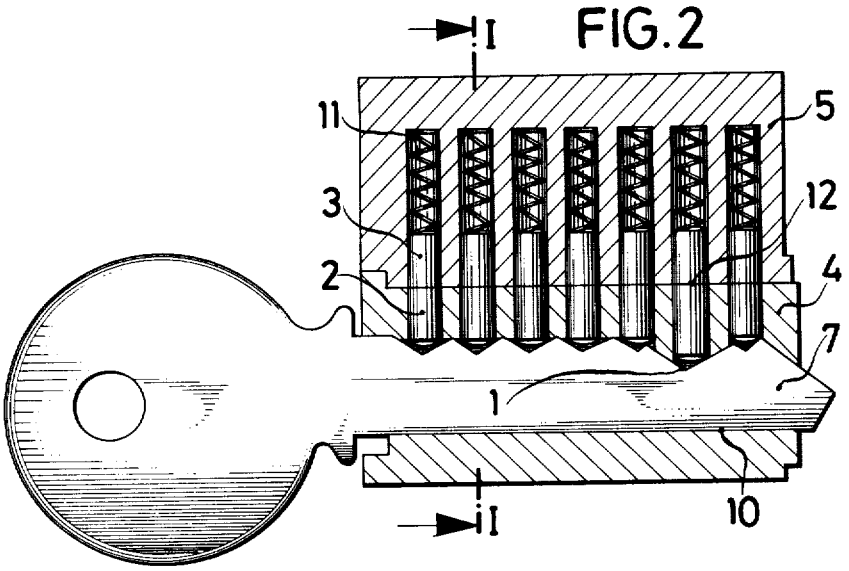

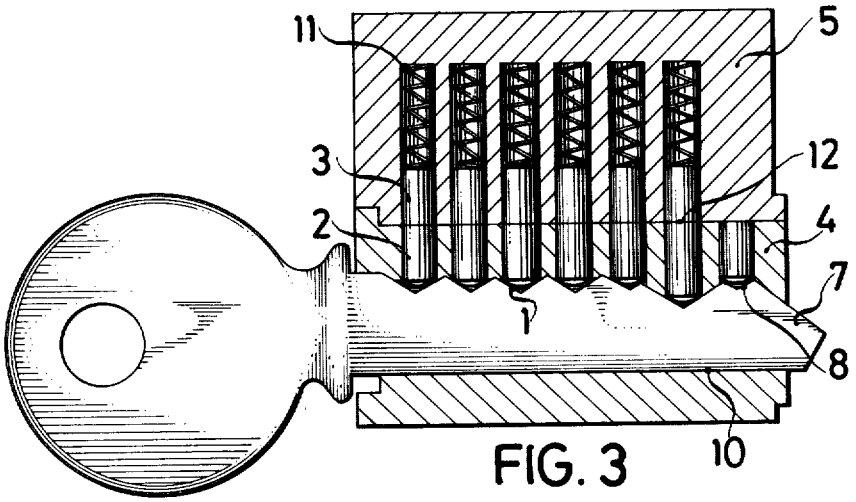
FIG. 3
FIG. 4
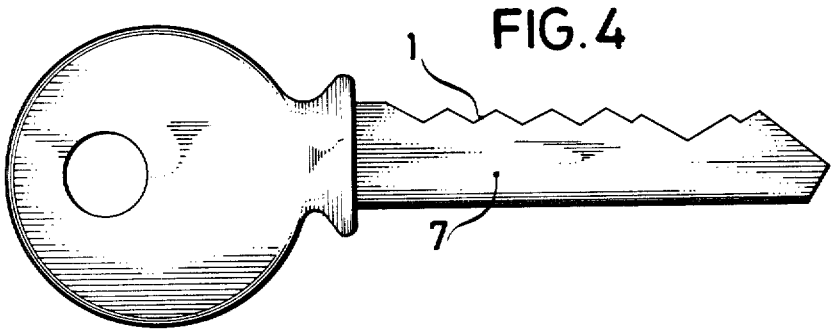
FIG. 5
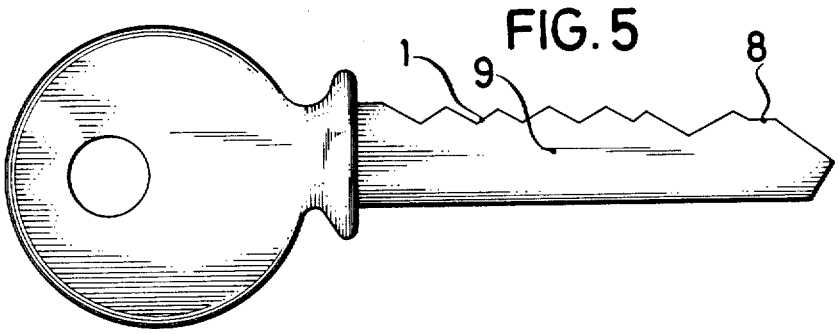

LOCK

The present invention relates generally to a lock of the cylinder type with pin tumblers and a key to operate such type of locks. Principally, the lock comprises a first cylinder and a second cylinder rotatably arranged in a cylindrical boring in the first cylinder. The second cylinder has a profiled key slot and may be locked from rotation by means of tumbler pins arranged in borings in the first and second cylinder, the tumbler pins extending down into the key slot. By introducing the correct key into the slot the upper end of the tumbler pins is lifted to a level corresponding to the inter surface of the first and second cylinder, thereby permitting relative rotation of the second cylinder.

More particularly, but not exclusively, the present invention relates to a lock where the second cylinder is equipped with a row of borings in which the tumbler pins are slidably arranged. The first cylinder is further equipped with a plurality of bores arranged in two parallel rows, the rows being radially arranged. Each row of bores in the first cylinder is arranged in such a way relative to the two rows of bores in the second cylinder that the former is coaxial with the latter, dependent upon the relative position of the two cylinders. Each of the borings in the first cylinder is preferably equipped with cylindrical top tumbler pin, the tumbler pins being spring loaded. The tumbler pins permit the second cylinder to be operated with a predetermined operating key to lock or unlock the lock when the operating key is inserted into the second cylinder.

The cylinder locks known in the art are equipped with bottom tumbler pins having such a length that, when a predetermined operating key is inserted into the key slot, the bottom tumbler pins are lifted axially in the bores to a level where the upper edge corresponds with the break line between the first and second cylinder. Thus, the locking effect of the tumbler pins is suspended, whereby rotation of the second cylinder relative to the first is permitted. In general, the lock has means which prevent the removal of the operating key from the lock unless the lock is in a locked position. In certain cases, however, the operator should be able to retract the key even when the lock is in a particular, unlocked position. This may be the case for the main entrance of offices, apartment buildings etc. where the janitor locks the main door at certain specific hours. The dwellers must then first unlock the door and then relock the door completely before they are able to retract the key from the key way.

Such type of locks are also commonly used in connection with electrical switches, such as a switch for operating a lift.

Locks which fulfil such requirements are well known in the art. The most common type comprises a particular front plate through which the key has to pass to enter the lock cylinder. The front plate is equipped with various openings which fit the cross sectional area of the key at its head and whereby the various keys may be retracted from the cylinder in different positions. Solutions of this type are rather complicated and require key with reduced cross sectional area at the head end.

The object of the invention resides in the provision of a lock where a key may be removed from the lock in two different positions without having to design a key which is dependent upon a reduced cross sectional area at the head end. According to the present invention this object is achieved by providing one of the two rows of bores in the first, outer cylinder with at least one bore less than the bores in the second cylinder, whereby the key is prevented from retraction in all but one position of the second cylinder.

Correspondingly, the second row of bores in the outer cylinder has at least one additional bore when compared with the first row, this row being in the position where the key may be retracted from its position in the cylinder.

According to a preferred embodiment the extra bore(s) is located at the farther end of the cylinder.

In order to fully promote a fuller understanding of the above, and other aspects of the present invention, some embodiments will now be described, by way of examples only, and with reference to the accompanying drawings. The described embodiments are related to the most common tumbler lock, the so-called "Yale"-type. It should be appreciated that only the relevant parts of the lock is shown and described.

The lock comprises several units and compartments other than those shown. Since these elements do not form a part of the present invention, but are considered as well known for a person skilled in the art, these components are not shown or described.

FIG. I shows a vertical cross section through the outer and the inner cylinder with a key inserted in the key-way, seen along the line C-C on FIG. II;

FIG. II shows a vertical, axial section through the cylinder shown on FIG. I, seen along the line A-A on FIG. I and with inserted key;

FIG. III shows a similar vertical section through the cylinder shown on FIG. I, where the inner cylinder is rotated to position B;

FIG. IV shows a side elevation of the key, correct in shape for aligning the tumblers on FIGS. I–III, the shape being such that the key may be retracted in a single position only; and FIG. V shows a key which may be retracted both when the cylinder is in a locked and an unlocked position.

FIG. I shows a vertical cross section through the outer cylinder 5 and the inner cylinder 4 with the key 7 inserted in the key-way. The section is seen through one set of bores. The inner cylinder 4 is equipped with a row of radially arranged bores in which the bottom tumbler pins 2 are slidably arranged. In the locked position, i.e. in a position where the predetermined key 7 is not in an inserted position in the key-way, the bottom tumbler pins 2 extend down into the key-way, while the top tumbler pins 3 extend into the bores in the inner cylinder 4, thereby preventing the latter from rotating.

The outer cylinder 5 is on the other hand equipped with a plurality of bores, arranged in two parallel, radial rows A,B. The two rows form together a V. The rows of bores A,B in the outer cylinder 5 are further arranged in such a way that they are co-axial with the bores in the inner cylinder 4, depending upon which of the two positions A,B the inner cylinder 4 is in. Each row of bores in the outer cylinder 5 incorporates a slidably arranged top tumbler pin 3, the pins 3 being spring-loaded by means of a helical spring 11.

FIG. II shows a vertical section through the cylinders 4,5, seen along the lines A-A on FIG. I. The section extends through the key-way. The Figure shows further a key 7 with correct shape inserted into the key-way, the inner cylinder 4 being in position A. As shown on FIG. II the key 7 will align the tumblers with the border between the inner cylinder 4 and the outer cylinder 5 due to the depth of the various notches of the key. Since the locking effect of the tumblers is suspended, the inner cylinder 4 is allowed to rotate relative to the outer cylinder.

FIG. III shows a vertical section through the cylinders 4,5 on FIG. I, seen along the row B of bores. In this position the inner cylinder 4 with the key 7 has been rotated to a position where the row C of bores in the inner cylinder 4 is coaxial with the row B of bores in the outer cylinder 5. In this position, conventional means (not shown) is actuated by the inner cylinder 4 so that the door in which the lock is arranged, may be opened.

When the inner cylinder 4 is rotated, the bottom tumbler pins 2 will follow the cylinder 4 and the key 7 is prevented from retraction. According to the embodiment shown on FIG. III the row B of bores consist of a bore less than the row A. Thus, when the cylinder 4 arrives at position B, the key is still locked from retraction, since the lower tumbler pin 2 in the inner position cannot move axially due to the lack of bore at the inner position. Thus the notch 8 and the bottom tumbler pin 2 thus prevent the retraction of the key 7.

FIG. IV shows a key 7 having the correct shape to align the tumblers with the border between the inner cylinder 4 and the outer cylinder 5, as shown on FIGS. I–III. Since the key 7 at its extreme position has a notch 8, the key 7 may only be removed from the inner cylinder 4 when in locked position, i.e. in position A. Such a case is shown on FIG. II.

FIG. V shows a key which apart from a single detail, corresponds to the key 7 shown on FIG. IV. The only difference between the two keys is that the notch 8 at the extreme end of the key 9 is removed. By applying the key 9 to the lock shown on the Figures, the key 9 may be inserted or retracted from the inner cylinder 4 both in position A and position B.

What is claimed is:

1. A pin tumbler lock and first and second keys therefor comprising:

(a) a pin tumbler lock including:

(i) an outer cylinder;

(ii) an inner cylinder rotatably mounted in said outer cylinder;

(iii) said inner cylinder having a keyway adapted to receive a first key and a second key therein;

(iv) a single row of parallel bores disposed in said inner cylinder, each said bore having a lower tumbler pin disposed therein;

(v) said outer cylinder having a first row and a second row of parallel bores disposed therein, the number of bores in said first row being at least one greater than the number of bores in said second row, said first and second rows defining a first position and a second position of said inner cylinder wherein the bores of said inner cylinder are coaxial with the bores in the respective rows of the outer cylinder;

(vi) each of said bores in said outer cylinder having upper tumbler pins respectively disposed therein;

(b) a first key, said first key having notches thereon adapted for positioning said lower tumbler pins in said inner cylinder, said lower tumbler pins engaging corresponding notches for enabling rotation of said inner cylinder and at least one of said lower tumbler pins engaging a corresponding one of said notches for preventing retraction of said first key except when said inner row of bores in said inner cylinder is aligned with said first row of bores in said outer cylinder; and (c) a second key, said second key having notches thereon for engaging each lower tumbler pin except said at least one of said lower tumbler pins so that said second key may be retracted when the row of bores in said inner cylinder is aligned with said bores in the outer cylinder both at said first position and said second position.

2. The lock and keys of claim 1 wherein the rows of bores in the outer cylinder are inclined to one another in a V.

3. The lock and keys of claim 1 wherein there is no notch at the end of said second key and wherein the extra bore is at the farther end of said cylinders.

* * * * *